US012262858B2

(12) United States Patent
Zorzo

(10) Patent No.: US 12,262,858 B2
(45) Date of Patent: Apr. 1, 2025

(54) DEVICE FOR RELEASING AND DETACHING A FLOOR CLEANING CLOTH FROM THE SUPPORT BASE RETAINING IT

(71) Applicant: TTS Cleaning S.R.I., Santa Giustin (IT)

(72) Inventor: Marco Zorzo, S. Giustina in Colle (IT)

(73) Assignee: TTS Cleaning S.R.I., Santa Giustina (IT)

( * ) Notice: Subject to any disclaimer, the term of this patent is extended or adjusted under 35 U.S.C. 154(b) by 510 days.

(21) Appl. No.: 17/721,782

(22) Filed: Apr. 15, 2022

(65) Prior Publication Data

US 2022/0330783 A1 Oct. 20, 2022

(30) Foreign Application Priority Data

Apr. 16, 2021 (IT) ..... 2021000009749

(51) Int. Cl.

| | |
|---|---|
| ***A47L 13/50*** | (2006.01) |
| ***A47L 13/16*** | (2006.01) |
| ***A47L 13/256*** | (2006.01) |
| ***A47L 13/258*** | (2006.01) |
| ***A47L 13/42*** | (2006.01) |

(52) U.S. Cl.

CPC ..... *A47L 13/50* (2013.01); *A47L 13/16* (2013.01); *A47L 13/256* (2013.01); *A47L 13/258* (2013.01); *A47L 13/42* (2013.01)

(58) Field of Classification Search

CPC ..... A47L 13/24; A47L 13/51; A47L 13/58; A47L 13/255; A47L 13/256; A47L 13/258; A47L 13/44; A47L 13/254; A47L 13/46; A47L 13/20; A47L 13/16; A47L 13/59

See application file for complete search history.

(56) References Cited

FOREIGN PATENT DOCUMENTS

| | | | | |
|---|---|---|---|---|
| IT | UA20163910 A1 | | 11/2017 | |
| JP | 2006271753 A | * | 10/2006 | |
| WO | WO-2014079518 A1 | * | 5/2014 | ..... A47L 13/16 |

* cited by examiner

*Primary Examiner* — Eric J Rosen
*Assistant Examiner* — John C Merino
(74) *Attorney, Agent, or Firm* — QuickPatents; Kevin Prince

(57) ABSTRACT

This is a device for releasing and detaching a cleaning cloth from the base that retains it; and in particular the release and detachment device of the invention allows you to release and detach from the base a cleaning cloth that has pockets within which are inserted the lateral ends of said base supporting the cloth.

8 Claims, 9 Drawing Sheets

DEVICE FOR RELEASING AND DETACHING A FLOOR CLEANING CLOTH FROM THE SUPPORT BASE RETAINING IT

CROSS-REFERENCE TO RELATED APPLICATIONS

This application claims the benefit of Italian Patent Application IT 2021/00009749, filed on Apr. 16, 2021, and is incorporated herein by reference.

STATEMENT REGARDING FEDERALLY SPONSORED RESEARCH AND DEVELOPMENT

Not Applicable.

FIELD OF THE INVENTION

The object of the invention relates to a device for releasing and detaching a cleaning cloth from the relative base that holds it. In particular, the release and detachment device of the invention makes it possible to detach, from the base, a cleaning cloth equipped with pockets, within which the lateral ends of said base supporting the cloth are inserted.

BACKGROUND

For the present invention, reference is made to mop bases that hold a cleaning cloth at their transverse ends, while the cleaning cloth, for cleaning floors, is held taut and in a planar position next to the surface of the base facing the floor. In fact, said bases comprise two or more parts hinged to each other, or on a central intermediate element, to form said planar support retaining the cloth. These hinged parts can, therefore, be tilted to allow, in their tilted and lowered condition, the cloth to be detached by having the lateral ends come out from the respective pockets of the cloth.

The parts that make up the base are kept flat by a joint or by a kinematic mechanism or by a push-button lever. In what follows, for illustration purposes, reference is made to a mop base where in order to release the aforementioned planar condition of the mop base, use is made of a part that protrudes from the base like a pedal button.

Sometimes, the aforementioned planar condition is maintained by a partial interference between the parts, and is released by forcing this interference; in any case the movement to restore the flat and operative position with a cloth connected to the base is a simple pushing movement, using the handle, of the base on the floor, while the release of the planar condition is obtained either by a reverse movement of the handle, holding the terminal ends of the base, or by using said button.

Existing release devices, connected to a bucket or trolley, release the planar condition by pressing the button or by forcing the retention interference of the planar condition.

The cloth, if it weighs a lot weight and has become heavy because of the water that has been absorbed, after the base has been freed from its planar condition, allows the hinged terminal ends to freely rotate, manages to tilt the ends until they detach by force of gravity and fall into a collection bucket positioned underneath.

However, more and more often disposable cloths are used for cleaning, or else they are made of another very thin and flimsy material, which are particularly inexpensive and have a high electrostatic charge due to the synthetic materials they are made of.

The cloths made of this material, even if they have the advantage of being very cheap and can, therefore, be replaced frequently, have the disadvantage that they adhere to the relative base when they are damp, making them very difficult to remove, which does not happen naturally.

Furthermore, the cloths of said materials, even if they are dampened, do not reach such a weight that they overcome the adhesion that keeps them joined to the relative base and therefore detach from the base under the force of gravity.

Finally, said materials, since they retain little water because they are not so thick or large, weigh so little that they are unable to tilt the hinged parts sufficiently to allow the terminal ends of the relative pockets to slip off.

A further drawback is that said cloths are basically rectangular and the end pockets, within which the ends of the parts that make up the base are inserted, are pockets whose inlet opening corresponds quite precisely to said ends of the base.

Said pockets do not have loose or overabundant material so that they can be easily removed from said ends.

For all the above reasons, the devices for releasing the planar part of the bases that retain a cloth using the pockets above the floor cleaning cloth cannot detach the relative cloth.

For the above-mentioned reasons, even if the operator, using the release devices of the prior art, had released the lateral portions connected to the central intermediate support of the base from the planar part, they would be forced to manually intervene to detach the cloth.

The aforementioned detachment is also prevented by the fact that some bases have elastic devices that tend to keep the half frames separate from each other, and tend to return the transverse free ends of the half frames in a divergent condition, after they have been brought closer together by rotating said half frames downwards with respect to the central intermediate element. With the aforementioned elastic devices, therefore, the half-shells of a mop base do not rotate freely downwards, assuming an approximately vertical position, but remain at a divergent inclination of about 30°, or even more, with respect to the vertical.

SUMMARY OF THE INVENTION

Objects of the Invention

The object of the invention, therefore, arises from the need of sector operators not only to release a cleaning cloth from the relative retaining base, but also to detach, and therefore to move, said cloth from said base without directly handling the cloth.

A further object of the present invention is to provide a release and detachment device that can be easily managed by the operator.

Another object of the present invention is to provide a release and detachment device that is reliable over time.

A further object of the present invention is to provide a release and detachment device that does not require too much effort to carry out.

An important object of the present invention is to provide a release and detachment device that can work with any type of cloth attached to the base.

Another important object of the present invention is to provide a release and detachment device that can work both with bases whose rotation of the half frames takes place with a frictional movement or limited by friction, as well as with bases whose rotation of the half frames is counteracted and/or limited by elastic devices.

A further object of the present invention is to provide a release and detachment device that is easy to use and that can operate without a precise connection with the base.

EXPLANATION OF THE INVENTION

All the aforementioned objects, and others that will be more fully apparent from the following explanation, are achieved by the release and detachment device that is the object of the present invention, according to the attached claims.

This is a device for releasing and detaching a floor cleaning cloth from the relative base, where said base comprises:

- a central element, called a retainer, connected with a handle and
- at least two half-frames hinged together or to said retainer, placed between said half-frames;
- a coupling device for keeping the two half-frames in a planar configuration;
- a button that works together with said coupling device to release said planar configuration; and
- a floor cleaning cloth with pockets at its transverse ends, within which the ends of said two half-frames can enter the openings of the pockets,
- where said half-frames are kept in a planar configuration by said coupling device controlled by a release button, and where said half-frames are hinged, and whose free ends can tilt downwards with respect to said retainer; characterized by the fact that it comprises:
- a raised cover with:
- a side opening, on the longitudinal side of said cover, of such a length that it can allow said base to enter beneath said cover in a planar configuration with a cloth,
- where said cover has a width equal to at least half the width of the base,
- a slot in the upper part of the cover in a central position extending further than the extension of the retainer and less than the distance between the openings of the pockets of the cloth; and
- one or more connections, on one or more perimeter edges of said cover or on one or more external walls of the cover, to solidly connect said cover to the top of a bucket or to a trolley or to another support structure.

Advantageous Characteristics of the Invention

Advantageously, said slot has an extension that is less than the extension of the retainer increased by the protrusion of the release button from the retainer, in such a way that the release button, when lifted by pulling the handle upwards, is pressed against the edges of the slot and then, following the continuation of the upward traction of the handle, the base passes through said slot.

Advantageously, said coupling device and the release button can be a single piece, which can use a simplified construction base.

Advantageously, said cover is a half cover or the section along a vertical plane of a cover, resulting in a simple construction and a simplified installation.

Advantageously, said side opening of the cover has a downwardly turned edge with the function of retaining and centering the base underlying the profile of the cover, Advantageously, said cover is configured as a dome or a cap or with a pyramidal trunk profile, with a shape that facilitates the rotation of the half-shells downwards before and/or during the crossing of the slot by the base.

Advantageously, said slot has, on at least one edge, a protruding extension configured like a claw to connect with the edge of the opening of said pockets.

Advantageously, the orthogonal edges of the slot are configured as a protruding claw, to connect with the edge of the opening of said pockets and the relative retention of the cloth.

DESCRIPTION OF THE DRAWINGS

The technical characteristics of the invention, according to the aforesaid objects, can clearly be seen in the claims below, and its advantages will become more readily apparent in the detailed description that follows, made with reference to the accompanying drawings, which illustrate a preferred embodiment, which is purely exemplary and not limiting, in which:

DETAILED DESCRIPTION OF THE PREFERRED EMBODIMENT

Figure 1:
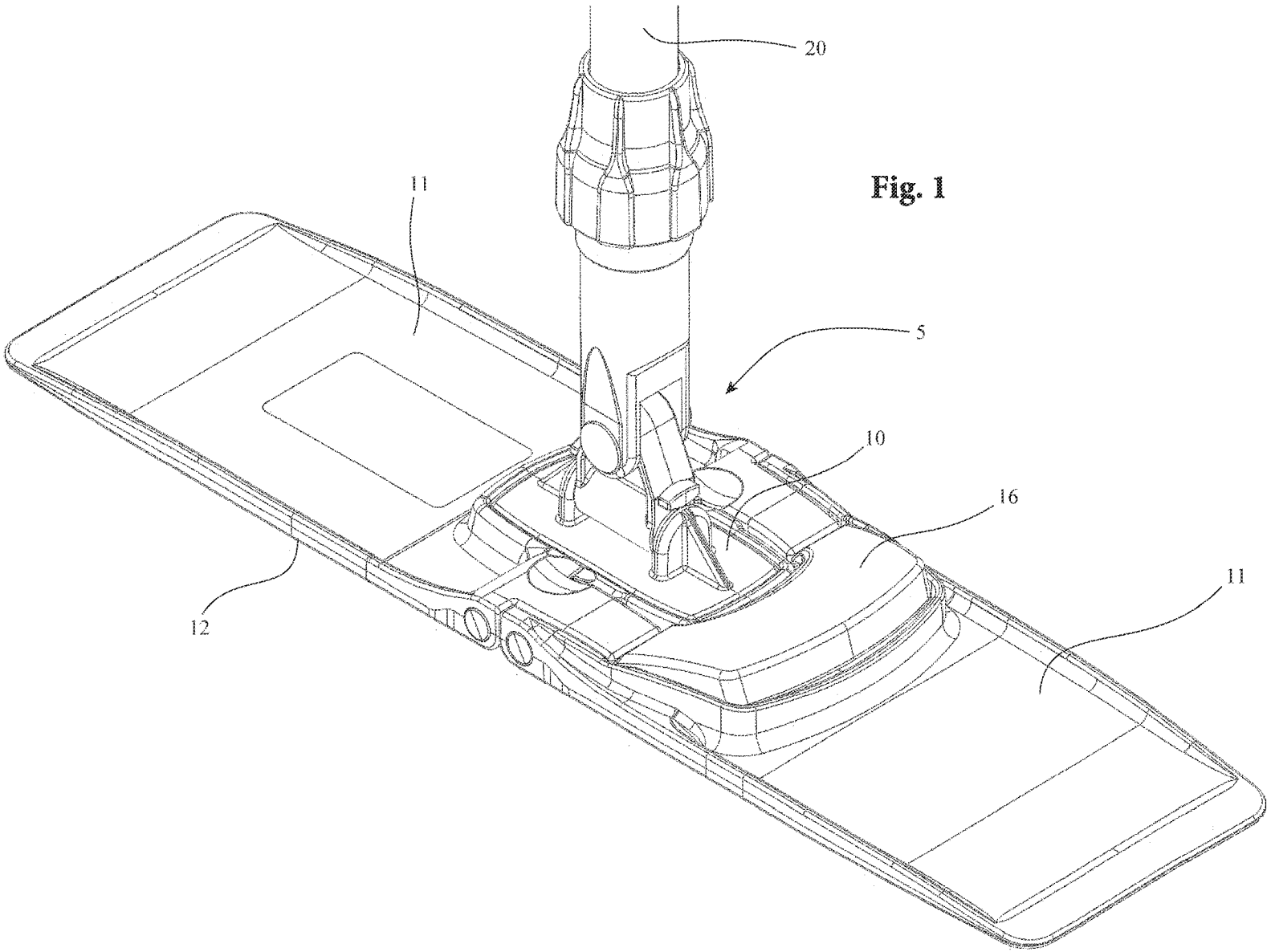
FIG. 1 shows a perspective view of a mop base equipped with two half frames hinged to an intermediate central element and positioned along a planar plane.
Figure 2:
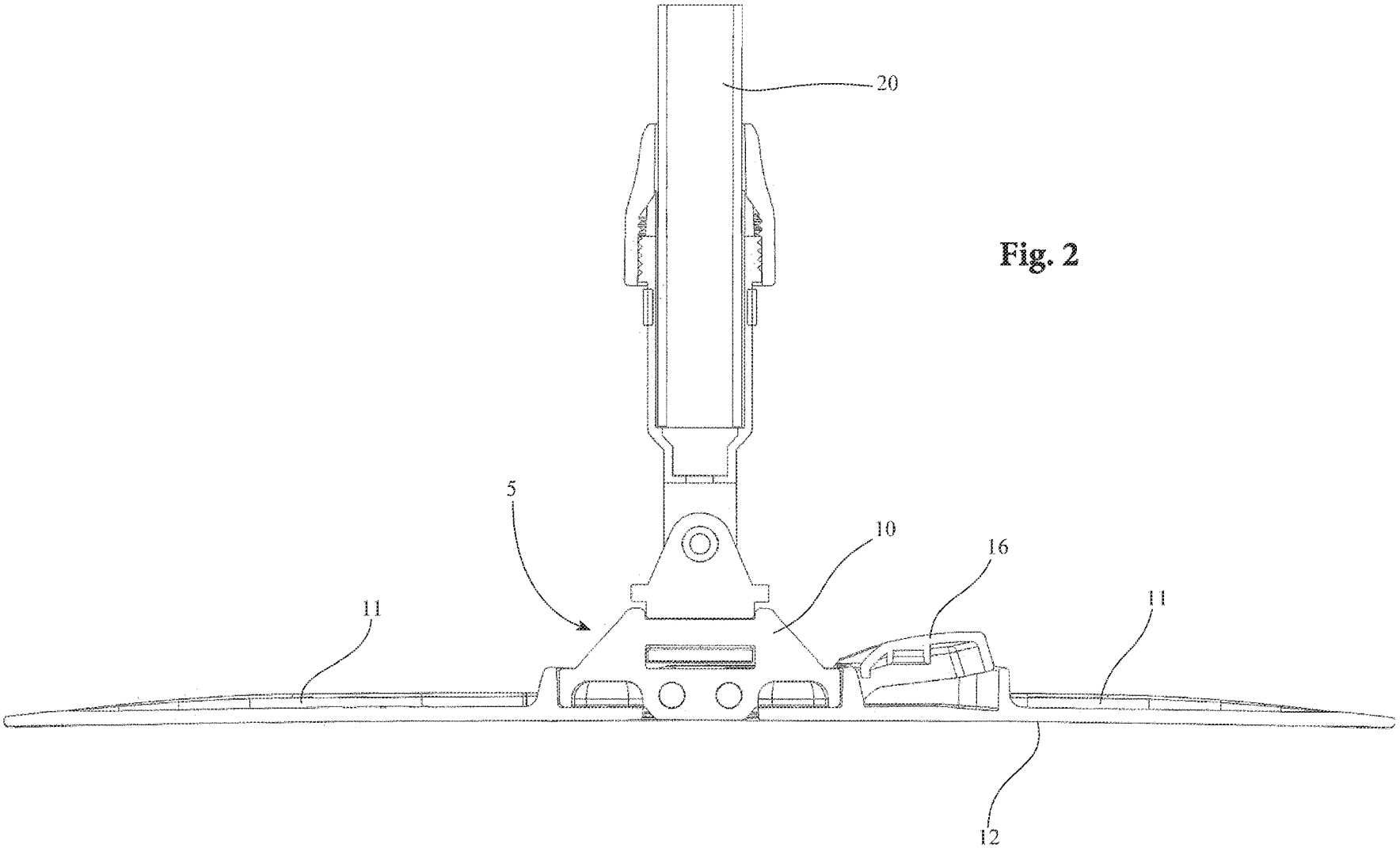
FIG. 2 shows a sectional view of the base of FIG. 1, along a vertical plane arranged parallel to the longitudinal extension of the base.
Figure 3:
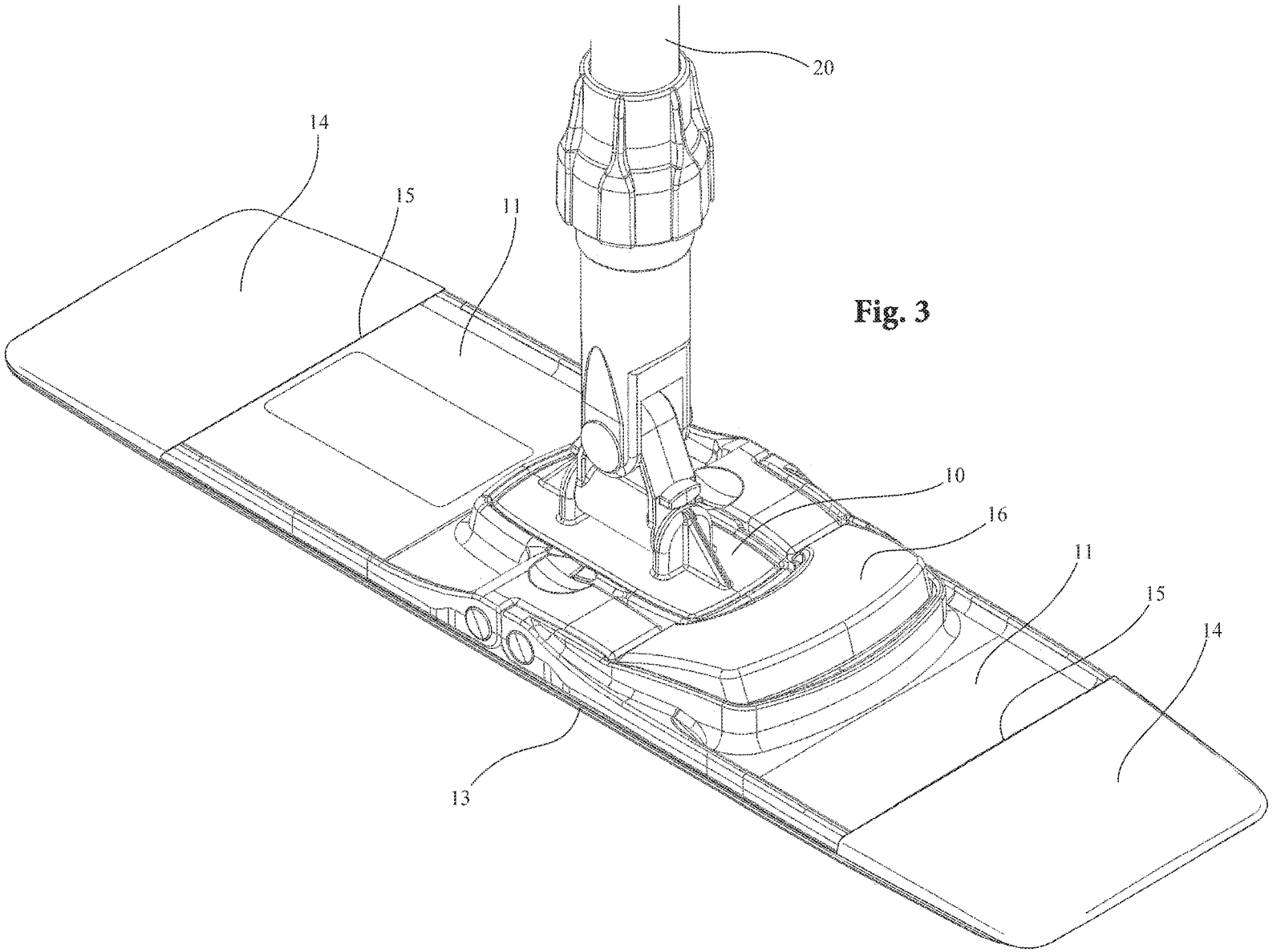
FIG. 3 shows the mop base of FIG. 1 with a cloth that has pockets, with the outer ends of the half-frames inserted within said pockets and holding said cloth in a taut manner facing the lower surface of the base.
Figure 4:
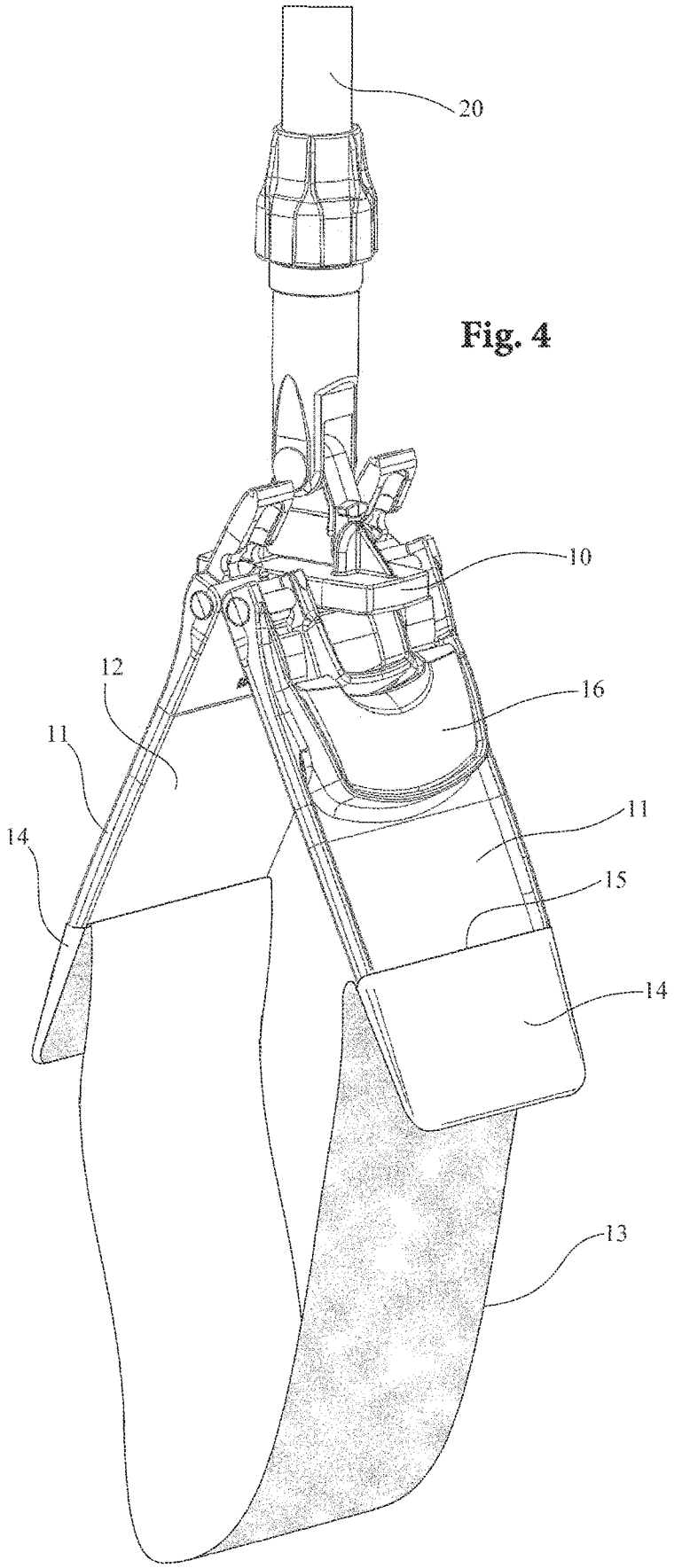
FIG. 4 shows a perspective view of the mop base with the half-planes tilted downwards with respect to the intermediate central element, with the ends of the half-planes still inserted within the pockets of the cloth.
Figure 5:
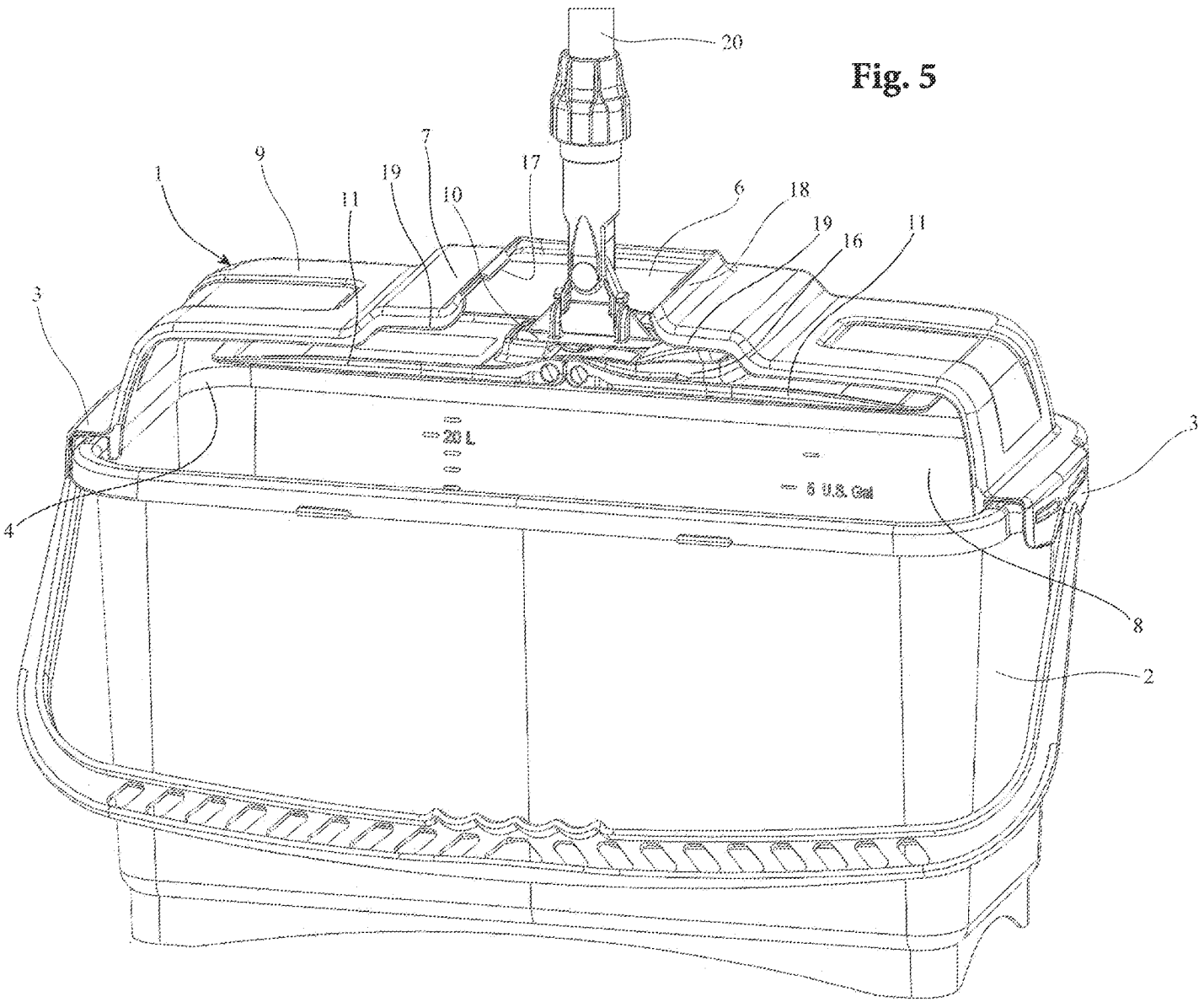
FIG. 5 shows a perspective view of the device of the invention attached to a bucket and with a mop base below said device.
Figure 6:
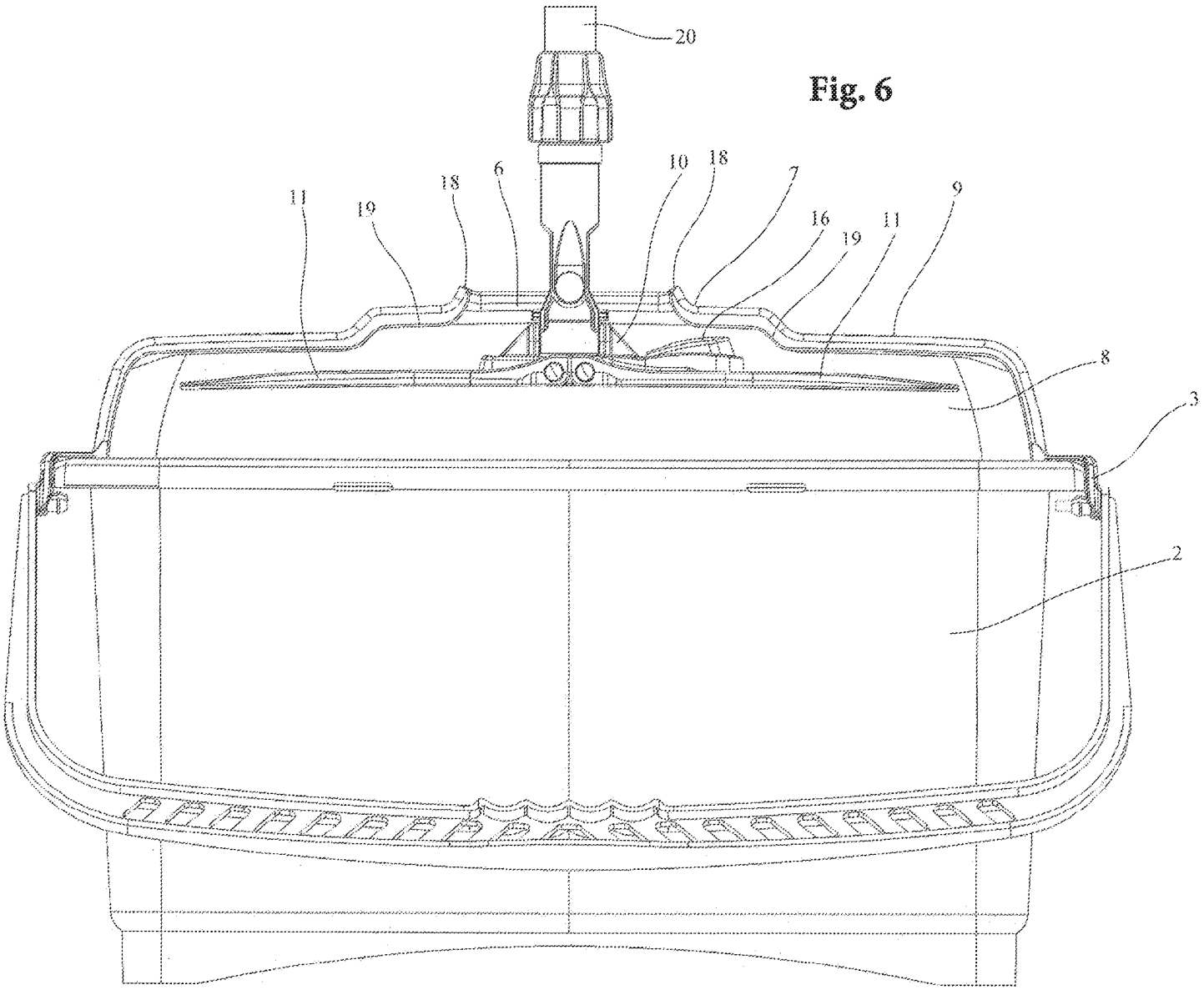
FIG. 6 shows side plan view of what is shown in FIG. 5 from the open side of the device, through which the base in a planar configuration is inserted inside and below the device.
Figure 7:
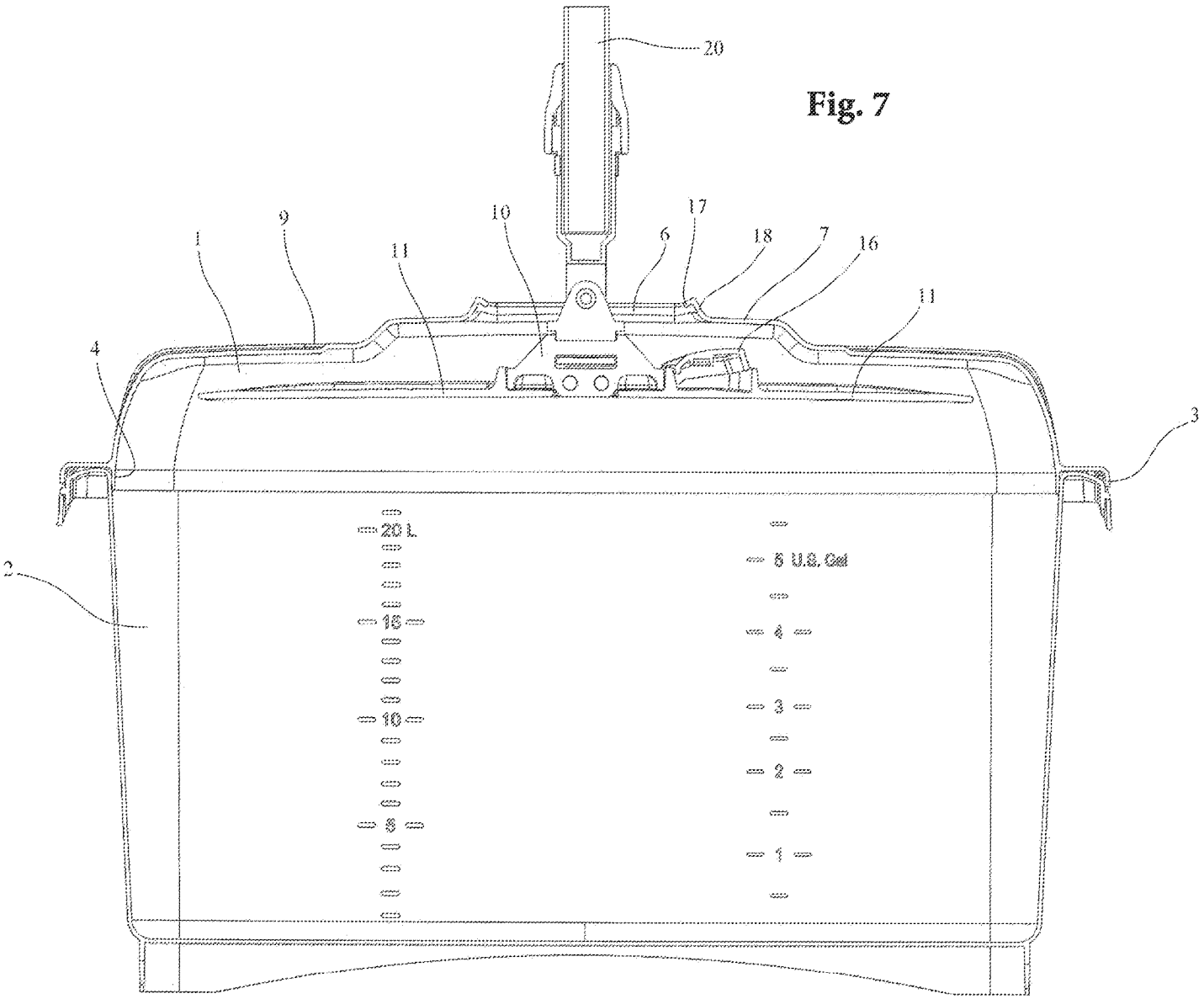
FIG. 7 shows a section view of what is shown in FIG. 6 along a vertical plane parallel to the longitudinal side of the device.
Figure 8:
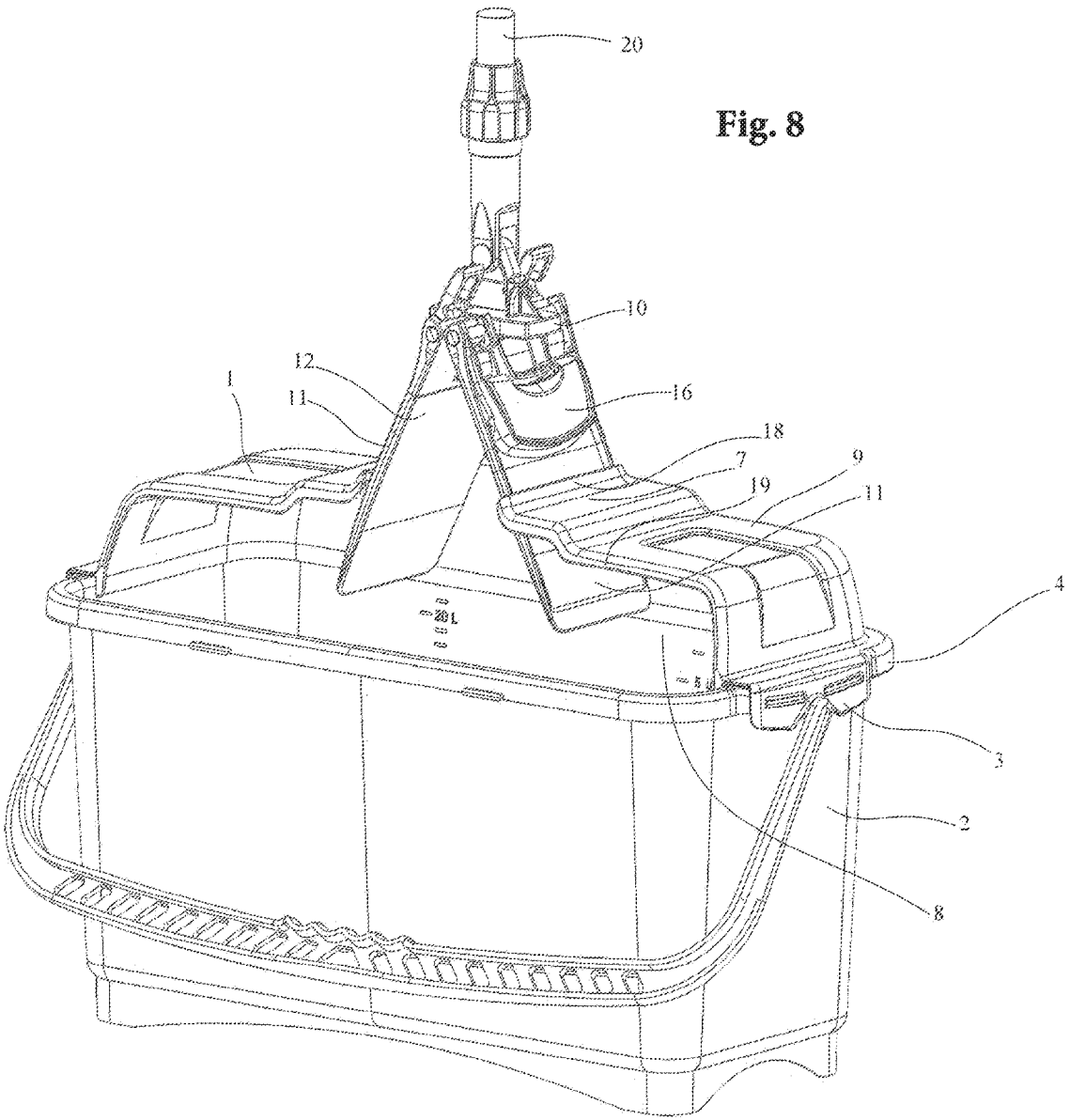
FIG. 8 shows a perspective view of the base with its half-planes tilted downwards, after being released, in passing through the slot above the device.
Figure 9:
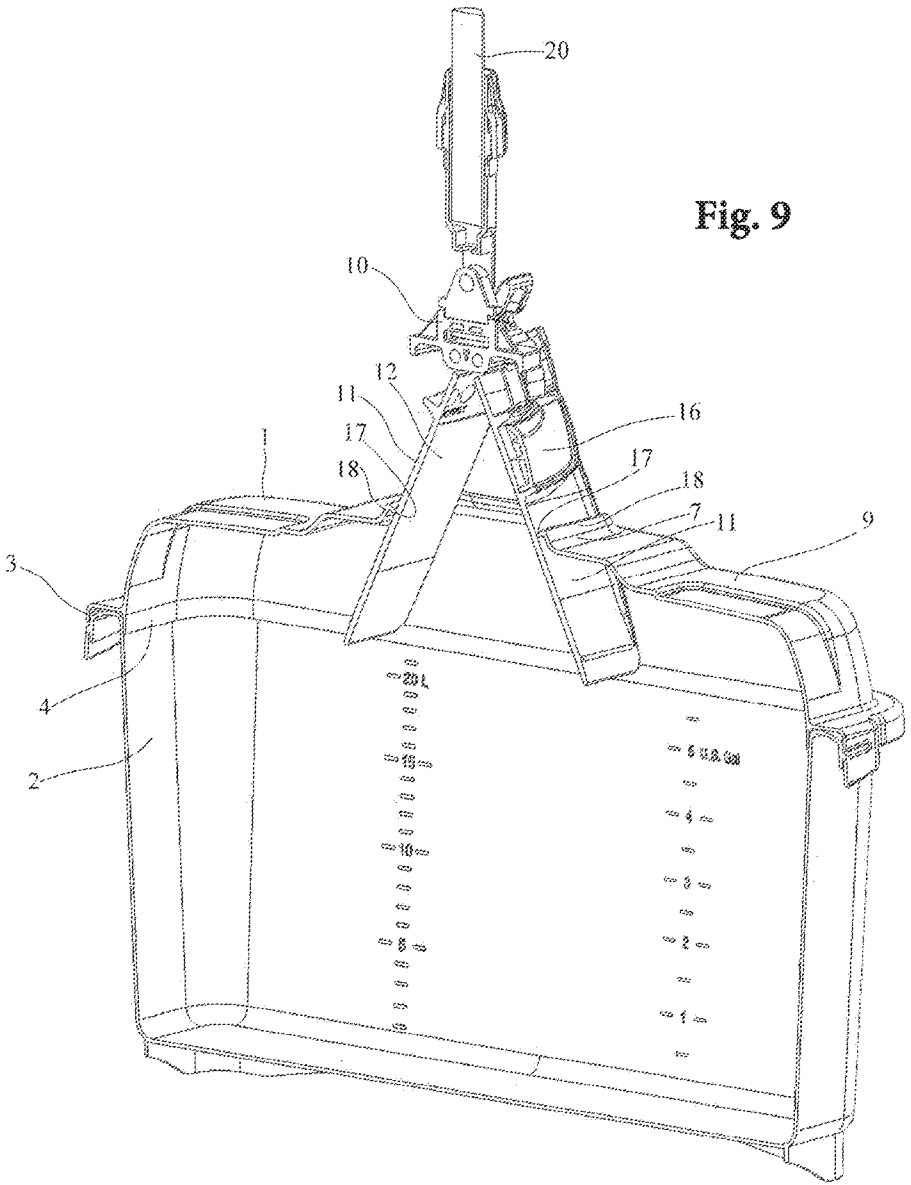
FIG. 9 shows a vertical section of what is shown in FIG. 8, highlighting the claw-configured elements on the edges of the slot for the detachment of the cloth in passing through the slot by the base pulled upwards by the handle.

With reference to the drawings, it is possible to see an embodiment of the device of the invention 1 over a bucket 2. Other embodiments, without departing from the scope of the invention, provide that the device of the invention can be part of or attached to a trolley or other support device, such as a wall, with the possible modification of the fixing and/or coupling devices on the outside of one or more walls of the device itself.

In the continuation of the description, reference will therefore be made to the bucket, which should also be understood as an extension of the additional retention and fixing possibilities.

The device 1 is solidly connected to the bucket 2 by means of the connections 3 on the perimeter edges 4.

The device 1 has the configuration of a raised cover 9 but could possibly be configured as a cap or dome or have a truncated pyramidal profile to connect better with the bucket 2 and possess, with a minimally thick profile, a structural configuration that is resistant to the upward stresses during the release of the planar part of the base 5 and the subsequent extraction of the base 5 through the slot 6 at the top in a central position 7 on the cover 9.

The side opening 8 of the cover 9 can be total or partial.

In the event that the side 8 is completely open, the cover 9 of the invention is in fact a cover sectioned along a vertical plane parallel to the longitudinal side or to the long side of the bucket 2 on which the cover 9 is constrained.

In the event that the side of the cover 9 is only partially open, the cover 9 of the invention has, in the wall with said lateral opening 8, an edge that is connected with the upper part of the bucket 2 and said opening 8 is greater than the base 5 and at least wide enough that the base 5 with a cloth 13 can enter the planar configuration and be arranged below the cover 9.

After the base 5 has passed through said side opening 8, the base 5, or part of it, is below the upper part of the cover profile 9 with the central member 10 of the base 5 at the slot 6.

Through the side opening 8, it is then possible to insert and impose on the cover 9 a base 5 with a cloth 13 in its planar configuration.

The size of this slot 6 is determined as an extension, to such a degree that it can carry out the function of a release, since the relative edges of the slot 6 can be connected with the release button 12, and is sufficient for the central element 10 and the half-frames 11 folded in a downwardly inclined manner to pass through, and forcing the removal of the cloth 13.

In fact, the mop base 5 used with said release and detachment device 1 is equipped with a central element 10 connected above the handle, and has two half-frames 11 hinged in such a way that they can tilt downwards with respect to the central element 10.

Eventually, said inclination, which corresponds to a downward rotation of the half-frames with respect to the intermediate element, is counteracted in its movement by friction in the hinges or by elastic devices that tend to oppose said inclination.

The base 5 also has a coupling device for maintaining the two half-shells 11 in a planar condition, which in the example of the drawings is a lever connected as a single piece to a pedal button 12, but which could also be detached and/or configured differently, for example in a kinematic system, or which can also consist of a temporary interference coupling, for maintaining the planarity of the two half-shells 11.

In this planar condition, the base 5 rests on the lower surface 12 the floor cleaning cloth 13.

The cloth 13 is kept on the base 5 by means of the insertion of the free ends of the half-frames 11 inside the pockets 14 of the cloth.

In order to remove the cloth 13 from the base 5, the half-frames 11 need to tilt downwards and the free ends of the half-frames 11 need to come out of the pockets 14.

The operation of the device of the invention

The cover 9 has a central slot 6 perpendicular to the longitudinal extension of the device 1, so that, from the side opening 8, namely from the open side of said cover 9, the base 5 can be set in a planar condition equipped with a cloth 13, making the handle and/or the central element 10 enter the slot 6, in whole or in part, and by pulling the handle upwards the release button 16 is pressed against the walls of said cover 9, near the slot 6, and acting on the kinematic system for maintaining the planarity, releasing the planarity of the two half-shells 11, and in the continuation of the pulling of the handle 20, the two half-shells 11 can, in passing through the slot 6 tilt downwards with respect to the central element 10, and by friction against said walls of the slot 6 or by the steep inclination of said half-shells 11, the extraction of the end part of the said half-shells 11 from the pockets 14 of the cloth 13 occurs, with the resultant detachment of the cloth 13 from the base 5.

For greater reliability in detaching the cloth 13 from the base 5, after pulling the handle 20, with no relative planar condition, for the release of the release device, and with the continuation of the pulling with the passing through of the half-shells 11 that gradually tilt more downwards passing through the slot 6, the edges 15 of the openings of the pockets 14 come to work together with the extensions 17 configured as a claw on the transverse edges 18 of the slot 6, forcing the end parts of the half-shells 11 to come out of the pockets 14, and retaining the relative cloth 13 and therefore implementing the aforementioned detachment.

The aforementioned operation and the certainty that the claw-shaped extensions connect with the edges of the pocket openings is explained by the fact that the pulling of the base, by means of the handle, forces the central intermediate part of the base to pass through said slot and the hinged parts of the half-shells to tilt by rotating downwards, but remaining resting, with its surfaces facing upwards, on the edges of the slot, also due to the presence of the aforementioned friction with the rotation of the hinges and/or elastic devices that tend to oppose the downward tilt of the half-shells.

By continuing to pull the handle, the semi-frames, with an increasing inclination when passing through the slot, carry the edges of the openings of the pockets into juxtaposition with the claw-shaped extensions, and while the passing through continues with a further greater degree of inclination of the semi-frames, the cloth is retained. Therefore the end parts of the base can come out from the pockets, achieving a complete detachment of the base from the mop, which is no longer retained and falls into the bucket onto which the device is fixed.

Eventually, the edges of the slot can be shaped in a manner corresponding to the claw-shaped extensions, similarly coupling with the opening edges of the pockets, and holding the cloth, while the free ends of the half-frames are removed from the pockets, arriving, as the base continues to move upwards, at being completely extracted and detached from the cloth.

In order to prevent that said base 5, during the aforementioned pulling of the base 5 by means of the handle, escapes from the side opening 8, it has a downwards turned edge 19 with the function of retaining and centering the base 5 underlying the profile of the cover 9.

What is claimed is:

1. A device for releasing and detaching a floor cleaning cloth from a base, where said base comprises:

- a central element, called a retainer, connected with a handle and two half-frames hinged together or to said retainer, said retainer disposed between said half-frames;
- a coupling device for keeping the two half-frames in a planar configuration;
- a release button that works together with said coupling device to release said planar configuration;

the floor cleaning cloth with pockets at its transverse ends, wherein the pockets include openings into which said two half-frames can enter;

where said half-frames are kept in a planar configuration by said coupling device controlled by the release button, and where said half-frames are hinged, and whose free ends can tilt downwards with respect to said retainer;

a raised cover with:

a side opening, on a longitudinal side of said cover, of such a length that it can allow said base to enter beneath said cover in a planar configuration with the cloth;

where said cover has a width equal to at least half the width of the base;

a slot in the upper part of the cover in a central position extending further than the length of the retainer and less than the distance between the openings of the pockets of the cloth;

one or more connections, on one or more perimeter edges of said cover, to solidly fix said cover to the upper part of a bucket or a trolley.

2. The device of claim 1 Wherein the length of the slot is less than the combined length of the retainer and the release button.

3. The device of claim 1 wherein said one or more connections and the release button are a single piece.

4. The device of claim 1 wherein the cover is a half-cover.

5. The device of claim 1 wherein said side opening of the cover has an edge turned downwards, thereby retaining and centering the base beneath the cover profile.

6. The device of claim 1 wherein said cover is configured as a dome or cap or with a truncated pyramidal profile.

7. The device of claim 1 wherein said slot has, on at least one transversal edge, a protruding extension in the shape of a claw to connect with the edge of the opening of said pockets.

8. The device of claim 1 Wherein the slot has transversal edges configured as a protruding claw, to connect with the edge of the opening of said pockets and the relative retention of the cloth.

* * * * *